US010663226B2

(12) United States Patent
Izawa et al.

(10) Patent No.: US 10,663,226 B2
(45) Date of Patent: May 26, 2020

(54) HEATING DRUM AND INK-JET PRINTING DEVICE EQUIPPED WITH THE SAME

(71) Applicant: Miyakoshi Printing Machinery Co., Ltd., Narashino-shi, Chiba (JP)

(72) Inventors: Hideo Izawa, Narashino (JP); Kouichi Ooyama, Yokote (JP); Kazushige Sato, Yokote (JP); Hidetoshi Kon, Yokote (JP)

(73) Assignee: MIYAKOSHI PRINTING MACHINERY CO., LTD., Narashino-shi, Chiba (JP)

( * ) Notice: Subject to any disclaimer, the term of this patent is extended or adjusted under 35 U.S.C. 154(b) by 0 days.

(21) Appl. No.: 16/205,930

(22) Filed: Nov. 30, 2018

(65) Prior Publication Data

US 2020/0031140 A1 Jan. 30, 2020

(30) Foreign Application Priority Data

Jul. 25, 2018 (JP) ..... 2018-139838
Aug. 17, 2018 (JP) ..... 2018-153700

(51) Int. Cl.
*F26B 3/20* (2006.01)
*F26B 13/14* (2006.01)
(Continued)

(52) U.S. Cl.
CPC ..... *F26B 13/18* (2013.01); *B41J 11/002* (2013.01); *F26B 3/20* (2013.01); *F26B 3/24* (2013.01); *F26B 13/14* (2013.01); *H05B 3/0095* (2013.01)

(58) Field of Classification Search
CPC ..... F26B 3/20; F26B 13/14; F26B 13/18
See application file for complete search history.

(56) References Cited

U.S. PATENT DOCUMENTS 3,228,462 A * 1/1966 Smith, Jr. ..... F26B 13/183 165/89
3,625,280 A * 12/1971 Peter ..... F28F 5/02 165/90

(Continued)

FOREIGN PATENT DOCUMENTS

JP 2012-007827 A 1/2012

OTHER PUBLICATIONS

Search Report of European Patent Office issued in European Application No. 18209363, in English, dated May 24, 2019 (8 pages).

*Primary Examiner* — Alessandro V Amari
*Assistant Examiner* — Kendrick X Liu
(74) *Attorney, Agent, or Firm* — Flynn Thiel, P.C.

(57) ABSTRACT

A heating drum, which guides a long-sized medium and also heats and dries the medium, includes a cylinder-shaped main body part, disc-shaped limb parts attached to the end parts of the main body part, and a shaft core attached to the limb parts. On an edge of an inner circumferential surface of the main body part, a cut-out part extending in the circumferential direction is formed. A groove part also extending in the circumferential direction is formed on the inner circumferential surface on an inner side from the cut-out part of the main body part. The cut-out part and the groove part are in parallel with each other, and the limb part is fitted to the cut-out part. A claw part is fixed to the limb part by a fitting tool, so that a hook part of the claw part is freely movably fitted to the groove part.

7 Claims, 10 Drawing Sheets

(51) Int. Cl.

| | |
|---|---|
| ***F26B 13/18*** | (2006.01) |
| ***F26B 3/24*** | (2006.01) |
| ***B41J 11/00*** | (2006.01) |
| ***H05B 3/00*** | (2006.01) |

(56) References Cited

U.S. PATENT DOCUMENTS

| | | | | |
|---|---|---|---|---|
| 4,184,268 | A * | 1/1980 | Christin | D21F 5/10 34/124 |
| 4,693,179 | A * | 9/1987 | Watts | B41F 15/0809 101/119 |
| 5,991,571 | A | 11/1999 | Yamada et al. | |
| 2011/0286764 | A1 | 11/2011 | Nomura et al. | |
| 2018/0086107 | A1 | 3/2018 | Allison et al. | |

* cited by examiner

HEATING DRUM AND INK-JET PRINTING DEVICE EQUIPPED WITH THE SAME

TECHNICAL FIELD

The present invention relates to a heating drum and an ink-jet printing device equipped with the same, and more specifically, concerns a heating drum in which even when heated at a high temperature, a limb part is prevented from being deviated relative to a main body part as much as possible, and an ink-jet printing device equipped with the same.

BACKGROUND ART

In the field of industrial machines, a heating drum has been adopted as a device for heating and drying a long-sized medium.

The heating drum guides the medium in a manner so as to be wound around and also to heat its surface so that the medium made in contact therewith can be heated and dried.

As the heating drum of this type, for example, a drum-type drying device, which is provided with a cylinder-shaped drum part that is rotatably supported and rotated when a base material is wound around, an engaging part disposed inside the drum part and a heating part that is detachably engaged with the engaging part, has been known (for example, see Patent Literature 1).

CITATION LIST

Patent Literature

PTL 1: Japanese Patent Application Laid-Open No. 2012-7827

SUMMARY OF INVENTION

Technical Problem

By the way, the conventional heating drum including the drum type drying device described in Patent Literature 1 generally has a cylinder-shaped main body part and disc shaped limb parts attached to the two end parts of the main body part.

In recent years, the heating drum is designed so as to heat the main body part at a temperature as high as possible in order to improve the transporting speed of the medium.

Then, in the heating drum, the main body part is expanded by heat, with the result that the limb part might be deviated from the main body part. Additionally, when the limb part is deviated relative to the main body part, the center of gravity is deviated, with the result that the rotation of the heating drum might become irregular, and in some cases, the limb part might fall down from the main body part.

In view of the above-mentioned circumstances, the present invention has been devised, and its object is to provide a heating drum which, even when heated at a high temperature, is capable of suppressing the limb part from being deviated relative to the main body part, and an ink-jet printing device equipped with such a heating drum.

Solution to Problems

As a result of earnest study made by the present inventors in view of solving the above-mentioned problems, they have found that, by providing a configuration in which the limb part is fit to a cut-out part of the main body part, a claw part fixed to the limb part is freely movably fitted to a groove part on the main body part.

The present invention relates to a heating drum in which, (1) in order to guide a long-sized medium and also to heat and dry the medium, a cylinder shaped main body part, disc-shaped limb parts attached to the two end parts of the main body part, and a shaft core attached to the limb parts are installed. In the heating drum, on the edge of the inner circumferential surface of the main body part, a cut-out part that extends in the circumferential direction is formed and a groove part that extends in the circumferential direction is formed on the inner circumferential surface on the inner side from the cut-out part of the main body part, wherein the cut-out part and the groove part are in parallel with each other. The limb part is fitted to the cut-out part, with a claw part being fixed to the limb part by a fitting tool, so that a hook part of the claw part is freely movably fitted to the groove part.

The present invention relates to the heating drum described in the above-mentioned (1) in which (2) the side face of the main body part and the surface of the limb part are flushed with each other.

The present invention relates to the heating drum in the above-mentioned (1) or (2) in which, (3) on the edge part of the inner circumferential surface of the main body part, a cut-out part with a narrow width which extends in the circumferential direction is further formed, and the cut-out part and the narrow-width cut-out part are alternately disposed, with the width of the narrow-width cut-out part being set to be smaller than the width of the cut-out part. A plurality of cut-out parts on the limb side are formed on the limb part with a predetermined interval so that an end part of the limb part with no limb-side cut-out part being formed thereon is fitted to the cut-out part, with an end part of the limb part with the limb-side cut-out part being formed thereon being fitted to the narrow-width cut-out part.

The present invention relates to the heating drum described in any one of the above-mentioned (1) to (3) in which (4) a plurality of hole parts are formed on the limb part so that through the hole part, the claw part is fixed to the limb part with a fitting tool.

The present invention relates to the heating drum described in the above-mentioned (4) in which (5) of the surface area of the limb part, the rate of the sum of the surface areas occupied by the plural hole parts is 30% or more.

The present invention relates to an ink-jet printing device that is provided with (6) a printing part which, while transporting a long-sized medium, carries out a printing process thereon, and a drying device which, while transporting a printed object formed by applying a printing process onto the medium by the printing part, dries the medium. The printing part is constituted by a plurality of ink-jet printing heads, and the drying device is provided with a heating drum described in any one of the above-mentioned (1) to (5).

The present invention relates to the ink-jet printing device described in the above-mentioned (6) in which (7) heating drums are installed in parallel with each other on the upstream side and the downstream side.

Advantageous Effects of Invention

In the heating drum of the present invention, by using a configuration in which the limb part is fitted to the cut-out part of the main body part, with a hook part of the claw part fixed to the limb part being freely movably fitted to the groove part, it becomes possible to suppress the limb part from being deviated in the width direction relative to the main body part as much as possible, even when heated at a high temperature.

Moreover, since the limb part is attached by utilizing the claw part so as to sandwich a convex part formed between the cut-out part of the main body part and the groove part, no fixing tool is directly used upon coupling the main body part and the limb part to each other. Therefore, it becomes possible to prevent the fitting tool from being loosened or from coming off by the expansion of the main body part.

At this time, by making the side face of the main body part and the surface of the limb part flushed with each other, the working safety at the time of maintenance can be improved.

In the heating drum of the present invention, in the case when on the edge part of the inner circumferential surface of the main body part, the cut-out part and the narrow-width cut-out part are alternately disposed and, a plurality of limb side cut-out parts are formed on the limb part with a predetermined interval, the end part of the limb part on which no limb-side cut-out part is formed is fitted to the cut-out part, with the end part of the limb part on which the limb-side cut-out part is formed being fitted to the narrow-width cut-out part. Since a step part is formed by the cut-out part on which the end part on the inner circumferential surface of the main body part is alternately disposed and the narrow-width cut-out part, the rotation of the limb part relative to the main body part is also regulated. For this reason, it is possible not only to prevent the limb part from being deviated in the width direction relative to the main body part, but also to prevent the limb part from being deviated in the rotation direction (surface direction perpendicular to the width direction) relative to the main body part.

In the heating drum of the present invention, the limb part can be made lighter by forming a plurality of hole parts on the limb part. For example, it is desirable to set the rate of the sum of surface areas occupied by the plural hole parts to 30% or more to make the limb part lighter.

Moreover, by forming the hole parts, the inside of the limb part can be visually recognized so that in some cases, the maintenance of the inside can be carried out through the hole parts with the limb part being attached to the main body part.

Furthermore, by fixing the claw part onto the limb part with a fixing tool through the hole parts, it is possible to easily attach the claw part to the limb part, together with an advantage in that the limb part is suppressed from protruding toward the outside.

In the ink-jet printing device of the present invention, since the drying device has the above-mentioned heating drum, the limb part is prevented from being deviated relative to the main body part of the heating drum even when heated at a high temperature.

Moreover, by installing the heating drums in parallel with each other on the upstream side and the downstream side, the drying time to the printed object to be transported can be made sufficiently longer.

DESCRIPTION OF EMBODIMENTS

Figure 1:
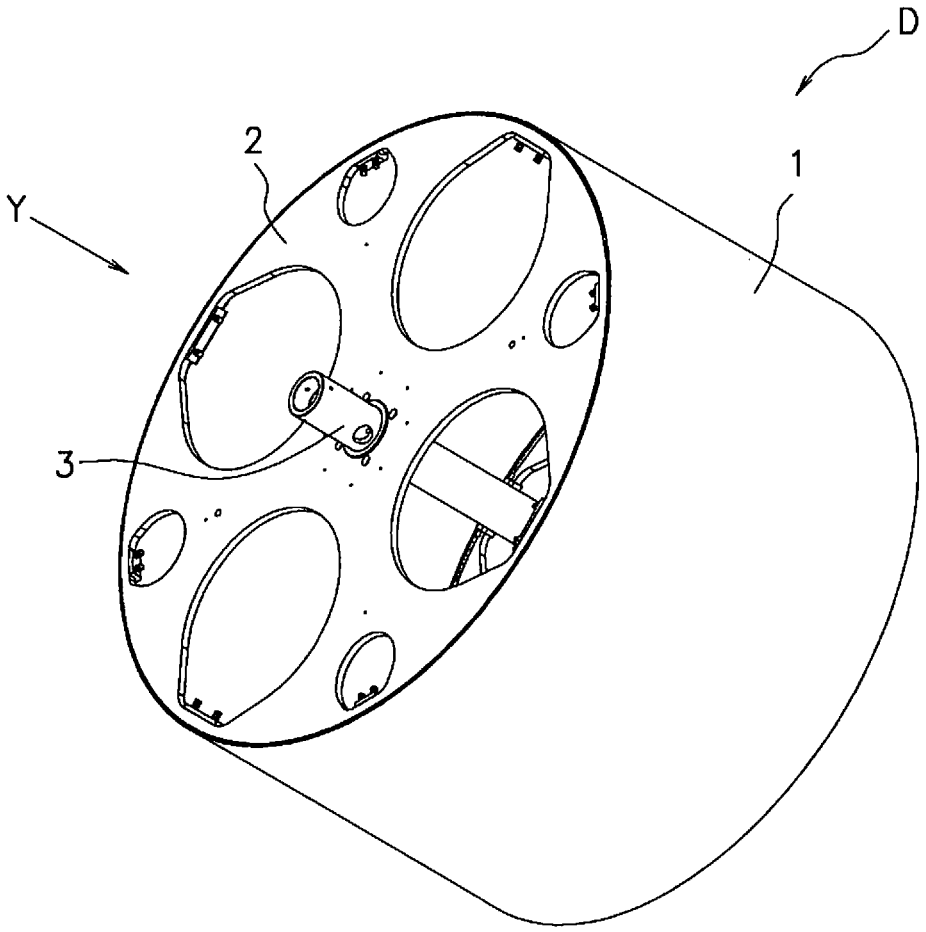
FIG. 1 is a perspective view showing a heating drum relating to the present embodiment.

Referring to drawings, the following description will discuss preferred embodiments of the present invention in detail. Additionally, in the drawings, the same components are indicated by the same reference numerals, so repeated descriptions thereof will be omitted. Moreover, the positional relationship, such as upper, lower, left or right side, is based upon the positional relationship shown in the Figure, unless otherwise particularly specified. Furthermore, dimensional ratios of the Figures are not intended to be limited by the dimensional ratios shown in the Figures.

First, explanation will be given to a heating drum D in accordance with the present invention.

FIG. 1 is a perspective view showing a heating drum D in accordance with the present embodiment.

As shown in FIG. 1, the heating drum D relating to the present embodiment is provided with a cylinder-shaped main body part 1, disc shaped limb parts 2 attached to the two end parts of main body part 1, and shaft cores 3 attached to the limb parts 2.

Moreover, in the heating drum D, the main body part 1, the limb parts 2, and the shaft cores 3 are integrally formed. That is, by rotating the main body part 1, the limb parts 2 and the shaft cores 3 are also rotated.

The heating drum D guides a long-sized medium in a manner so as to be wound around the heating drum D and also to heat its surface so that the medium in contact therewith can be heated and dried.

In this case, for example, a long-sized medium, such as paper, film, cloth, nonwoven fabric or the like, may be adopted as the medium although not particularly limited.

Moreover, as a specific example of heating and drying the medium, a heating and drying process for use in molding the medium, a heating and drying process for the medium on which machining has been carried out, and a heating and drying process for the medium on which printing has been carried out.

The main body part 1 has a cylinder-shape, and its outer circumferential surface is heated. That is, the medium is heated when made in contact with the outer circumferential surface of the main body part 1.

As the material for the main body part 1, metal such as aluminum or the like is used.

The main body part 1 has its outer circumferential surface subjected to irregularity machining, such as sand blasting, shot blasting, beads blasting or the like. Thus, when the medium and the outer circumferential surface of the heating drum D (main body part 1) are in contact with each other, should there be air intruded between these, the air can be released from gaps caused by the surface with irregularities, and by further enhancing the grip, the adhesion onto the drum can also be improved. As a result, it is possible to suppress the drying efficiency of the medium from being lowered.

Figure 2:
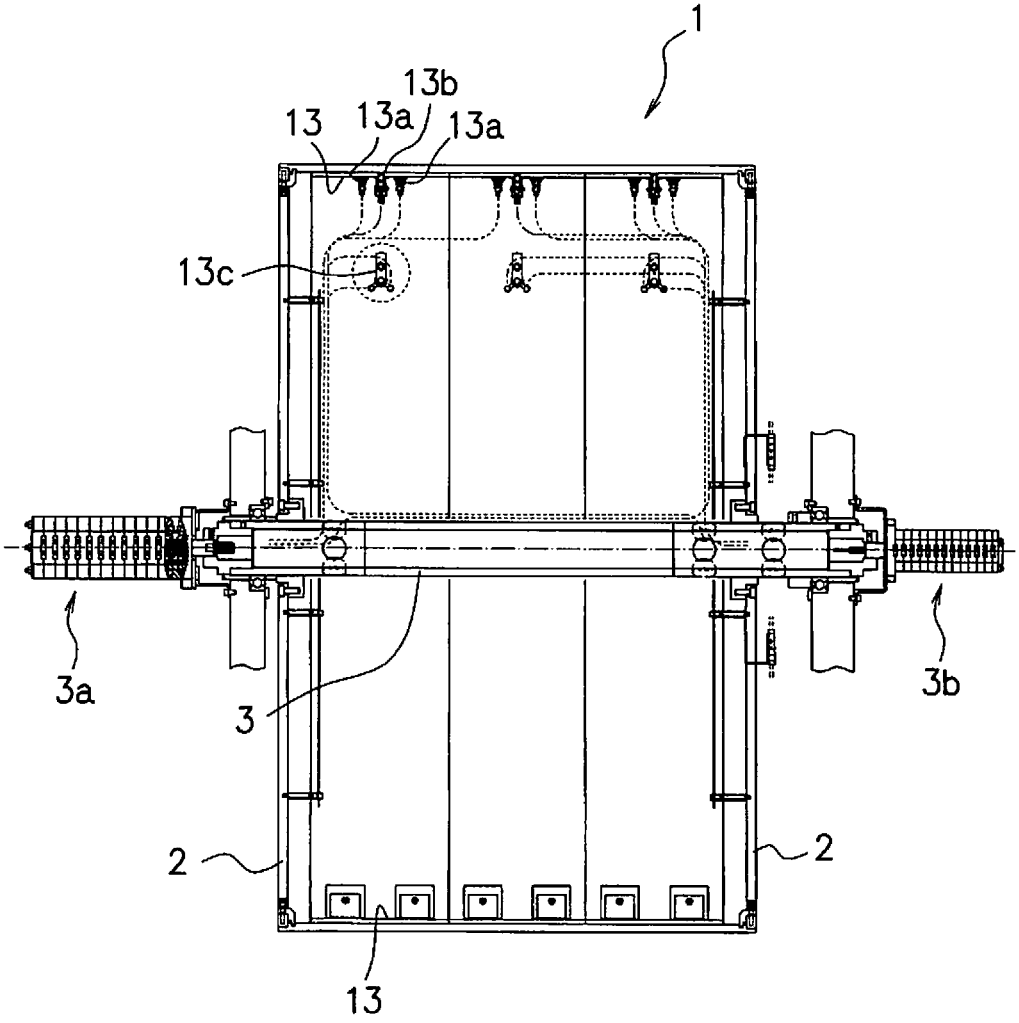
FIG. 2 is a horizontal cross-sectional view showing the heating drum relating to the present embodiment.

FIG. 2 is a horizontal cross-sectional view showing the heating drum D relating to the present embodiment. As shown in FIG. 2, in the main body part 1, a band heater 13 for use in heating the main body part 1 is attached to its inner circumferential surface.

The band heater 13 has an annular shape and is attached to the inside of the main body part 1 in a manner so as to be placed along the inner circumferential surface of the main body part 1.

Moreover, three sets of the band heaters 13 are placed in parallel with one another relative to the width direction of the main body part 1.

In each of the band heaters 13, a power source terminal 13*a*, a thermocouple 13*b* for measuring the temperature of the band heater 13, and a thermostat 13*c* for blocking the power supply to the heater upon occurrence of an abnormal heating process, are attached to the inner circumferential surface thereof.

Therefore, the temperature of each band heater 13 is settable independently and adjustable.

Moreover, for example, in the case when the width of the medium is small, the power source for the band heater 13 that is not used can be turned OFF.

Figure 3A:
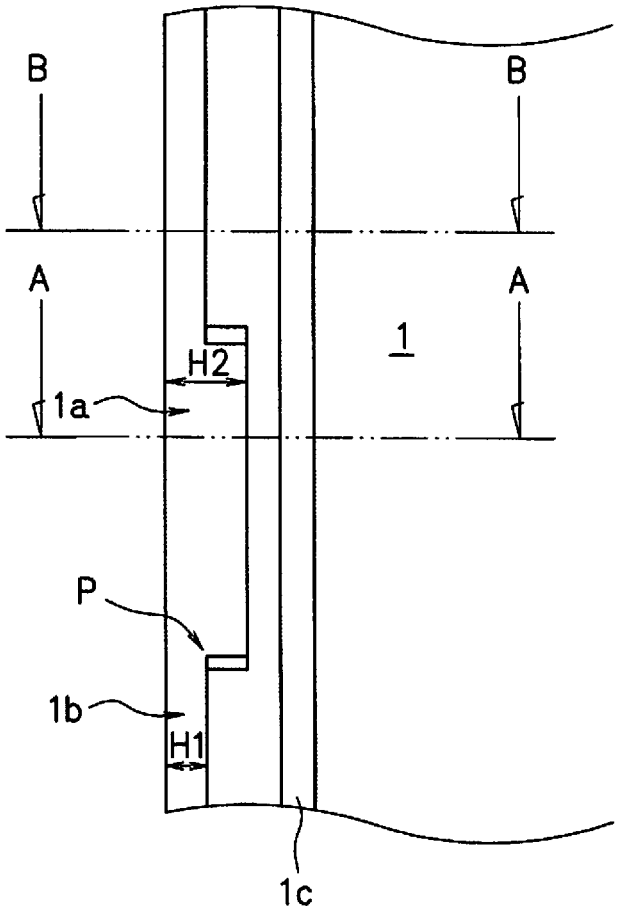
FIG. 3(A) is an enlarged view showing an edge part of a main body part seen from the inside of the main body part of the heating drum relating to the present embodiment.
Figure 3B:
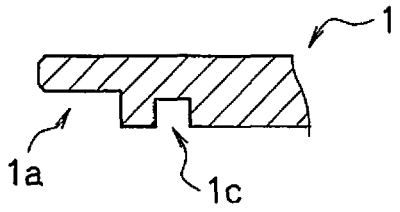
FIG. 3(B) is a cross-sectional view cut along an A-A surface of FIG. 3(A).
Figure 3C:
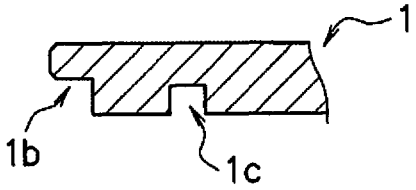
FIG. 3(C) is a cross-sectional view cut along a B-B surface of FIG. 3(A).

FIG. 3(A) is an enlarged view showing an edge part of a main body part seen from the inside of the main body part of the heating drum D relating to the present embodiment, FIG. 3(B) is a cross-sectional view cut along an A-A surface of FIG. 3(A), and FIG. 3(C) is a cross-sectional view cut along a B-B surface of FIG. 3(A).

As shown in FIG. 3(A), FIG. 3(B) and FIG. 3(C), in the main body part 1, on the edge part of the inner circumferential surface thereof, a cut-out part 1*a* extending in the circumferential direction and a cut-out part 1*b* with a narrow width extending in the circumferential direction are continuously formed. That is, the cut-out part 1*a* and the narrow-width cut-out part 1*b* are alternately disposed in the same circumferential direction. Additionally, end parts of a limb part 2 are fitted into the cut-out part 1*a* and narrow-width cut-out part 1*b*, as will be described later.

In the main body part 1, a distance H1 in the width direction (shaft core direction) of the narrow-width cut-out part 1*b* is made smaller than a distance H2 in the width direction of the cut-out part 1*a*.

Therefore, in the main body part 1, on the edge part on the inner circumferential surface, a step part P made by the cut-out part 1*a* and the narrow-width cut-out part 1*b* is formed.

In the main body part 1, on an inner side from the cut-out part 1*a* and the narrow-width cut-out part 1*b* of the inner circumferential surface, a groove part 1*c* extending in the circumferential direction is formed.

The groove part 1*c* is formed on the entire circumference of the inner circumferential face of the main body part 1. That is, the groove part 1*c* has an annular shape.

Moreover, the groove part 1*c* is in parallel with the cut-out part 1*a* and the narrow-width cut-out part 1*b*.

Returning again to FIG. 1, in the main body part 1, limb parts 2 are attached to its two sides.

Figure 4:
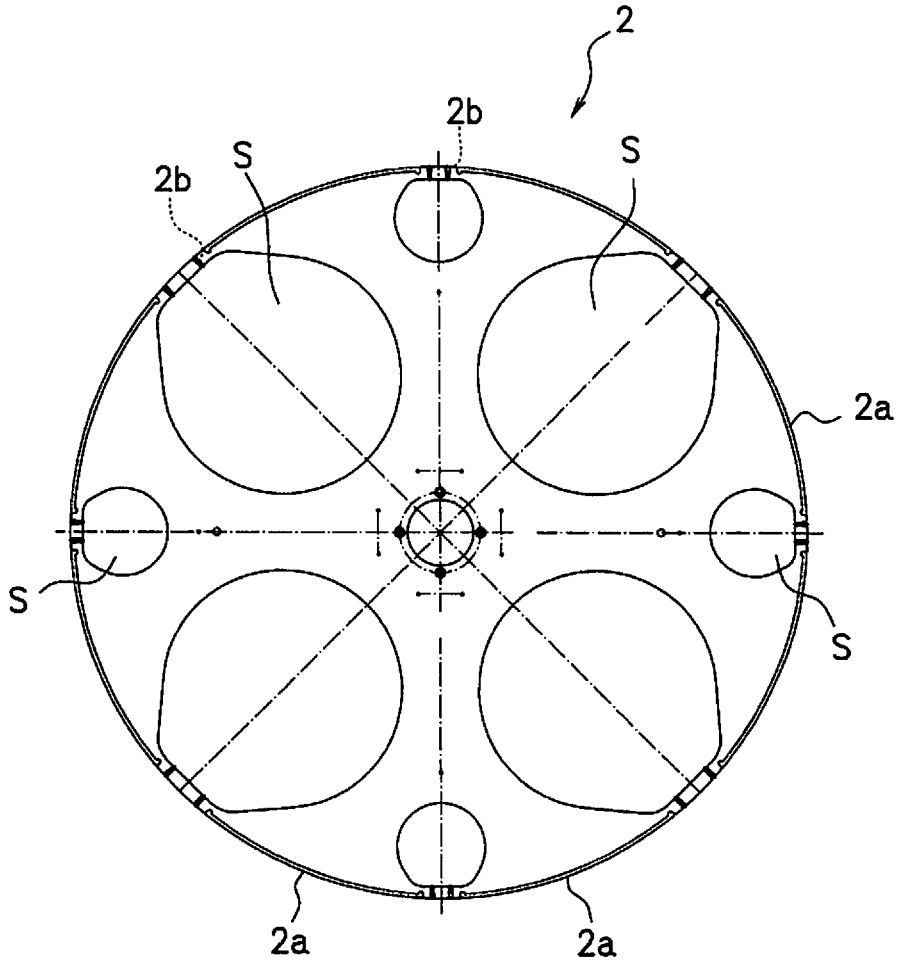
FIG. 4 is a front view showing a limb part of the heating drum relating to the present embodiment.

FIG. 4 is a front view showing the limb parts of a heating drum D relating to the present embodiment.

As shown in FIG. 4, each of the limb parts 2 has a disc shape so as to correspond to the side face of the cylinder-shaped main body part 1. By attaching the limb parts 2 to the side faces of the main body part 1 of the heating drum D, it is possible to suppress the main body part 1 from being contracted by repeated heating and cooling processes. Moreover, the heating efficiency can be enhanced and the working safety at the time of maintenance can also be improved. Additionally, the connection structure between the main body part 1 and the limb parts 2 in the heating drum D will be described later.

As the material for the limb parts 2, metal such as aluminum or the like may be used. Moreover, the material for the limb parts 2 is preferably the same as the material of the main body part 1 from the viewpoint of thermal expansion rate.

In the heating drum D, a plurality of hole parts S are formed on the limb parts 2. Additionally, each of the hole parts S is formed so that its end part is positioned between mutual cut-out parts 2*a* on the limb side to be described later. Thus, the limb parts 2 can be made lighter. Moreover, by forming the hole parts S, the inside of the limb part 2 can be visually recognized through the hole parts S so that in some cases, maintenance of the inside can be carried out through the hole parts S, with the limbs 2 being attached to the main body part 1.

In this case, of the area of the limb part 2 when seen in the top view, the rate of the sum of areas occupied by the plural hole parts S is preferably set to 30% or more, from the viewpoint of the above-mentioned effects, and is also more preferably set to 30 to 60% from the viewpoint of the strength.

On the end part of each limb part 2, a plurality of limb side cut-out parts 2*a* extending in the circumferential direction are formed with a fixed interval. Additionally, the end part of the limb part 2 on which the limb-side cut-out parts 2*a* are formed is fitted to the narrow-width cut-out part 1*b* as will be described later.

On the limb part 2, between the mutual limb-side cut-out parts 2*a*, a limb-use fitting tool hole 2*b* is formed so as to extend outward from the hole part S.

Returning again to FIG. 2, the shaft core 3, which has a cylinder shape, is attached and fixed to the center (rotation center of the main body part 1) of each of in the limb parts on the two sides.

As the material for the shaft core 3, metal such as carbon steel or the like is used. Moreover, the material of the shaft core 3 may be the same as the material of the main body part 1 or the limb part 2, or different therefrom.

The shaft core 3 has, for example, its two sides supported and fixed to a frame or the like respectively through a bearing. Thus, the heating drum D is made rotatable in the circumferential direction centered on the shaft core 3 relative to the frame.

In the heating drum D, to one end of the shaft core 3, a power-source use rotary connector 3*a* is attached, and to the other end, a signal-use rotary connector 3*b* is attached.

Moreover, a power-source terminal 13*a* of each of the band heaters 13 is connected to the power-source use rotary connector 3*a* through a cable, and each of the thermocouples 13*b* is connected to the signal-use rotary connector 3*b* through a cable.

In the shaft core 3, a portion between the power-source use rotary connector 3*a* and the signal-use rotary connector 3*b* is prepared as a hollow portion to make the shaft core 3 lighter. Additionally, in the hollow portion of the shaft core 3, the above-mentioned cables are allowed to pass.

Next, explanation is given to a connection structure between the main body part 1 and the limb part 2.

Figure 5:
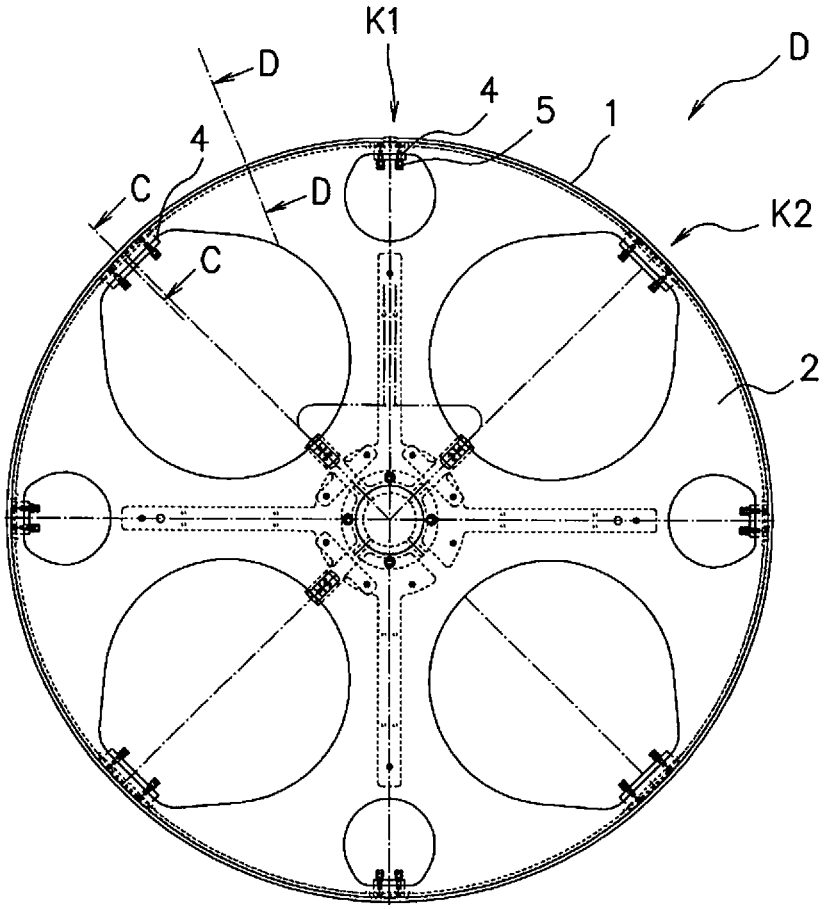
FIG. 5 is a front view seen in an arrow Y direction of FIG. 1.

FIG. 5 is a front view seen in an arrow Y direction of FIG. 1.

As shown in FIG. 5, the main body part 1 and the limb part 2 are coupled to each other at 8 portions by using claw parts 4 and fitting tools 5. More specifically, the main body part 1 and the limb part 2 are coupled to each other by using first coupling parts K1 at 4 portions formed on four sides and second coupling parts K2 at 4 portions formed between the mutual first coupling parts K1.

Additionally, in the heating drum D, the first coupling part K1 and the second coupling part K2 have different lengths in the circumferential direction. In this manner, by coupling the first coupling part K1 and the second coupling part K2 having different lengths in the circumferential direction, the sizes of the hole parts S of the limb parts 2 are made to have different areas in association with the lengths of the coupling parts. As a result, the ratio of the sum of the areas occupied by the hole parts S can be increased, and through the hole with a large area of the hole parts S, the inside of the limb part 2 can be visually confirmed and the maintenance work can be easily carried out.

Moreover, in the limb parts 2, by utilizing the hole parts S, the fitting tools 5 are attached to the claw parts 4 and limb parts 2, through the hole parts S. That is, through the hole parts S, the claw parts 4 are fixed to the limb parts 2 by the fitting tools 5. Thus, the claw parts 4 can be easily attached to the limb parts 2, and since the fitting tools 5 are prevented from sticking outward, the working safety at the time of maintenance can be improved.

In this case, as the fitting tools 5, bolts or the like can be used.

Figure 6A:
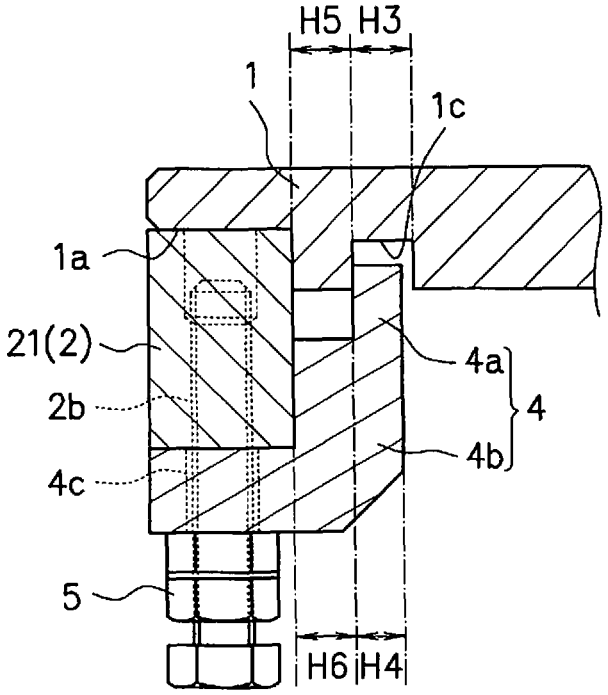
FIG. 6(A) is a cross-sectional view cut along a C-C surface of FIG. 5.
Figure 6B:
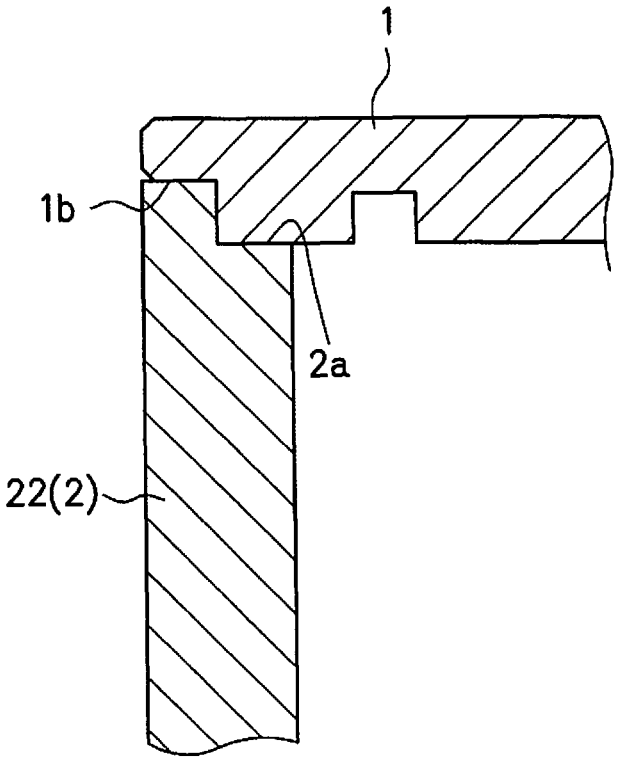
FIG. 6(B) is a cross-sectional view cut along a D-D surface of FIG. 5.

FIG. 6(A) is a cross-sectional view cut through a C-C surface of FIG. 5, and FIG. 6(B) is a cross-sectional view cut through a D-D surface of FIG. 5.

As shown in FIG. 6(A), in the first coupling parts K1 of the heating drum D, an end part 21 on which no limb-side cut-out part 2*a* is formed of the limb part 2 is fitted to the cut-out part 1*a*.

Moreover, onto the hole part S side of the end part 21, a claw part 4 is attached and fixed by fitting tools 5.

In this case, the claw part 4 is composed of a pressing part 4*b* having an L-letter shape seen in a side view and a hook part 4*a* protruding from the end part of the pressing part 4*b*.

Moreover, in the claw part 4, the pressing part 4*b* is made in contact with the surface on the hole part S side of the limb part 2 and the surface on the inside of the limb part 2, and the hook part 4*a* is freely movably fitted to a groove part 1*c* of the main body part 1.

Furthermore, in the claw part 4, a claw-use fitting tool hole 4*c* is formed on the pressing part 4*b* so as to be communicated with a limb-use fitting tool hole 2*b* of the limb part 2.

At this time, in the width direction of the main body part 1, a width H3 of the groove part 1*c* is made larger than a width H4 of the hook part 4*a* of the claw part 4*a*. Additionally, in the depth direction of the groove part 1*c*, a gap is also formed between the hook part 4*a* and the main body part 1.

Moreover, a distance H5 between the side face on the cut-out part 1*a* side of the groove part 1*c* of the main body part 1 and the side face on the groove part 1*c* side of the cut-out part 1*a* is the same as a distance H6 between the side face on the limb part 2 side of the hook part 4*a* of the claw part 4 and the surface on the inside of the limb part 2 with which the pressing part 4*b* is made in contact, or is made larger than the distance H6.

Furthermore, the diameter of the claw-use fitting tool hole 4*c* is made larger than the limb-use fitting tool hole 2*b*.

Therefore, the claw part 4 is attached and fixed to the limb part 2 with a fitting tool 5, with the pressing part 4*b* being made in contact with the limb part 2 and the hook part 4*a* being made in contact with the side face on the cut-out part 1*a* side of the groove part 1*c*. Thus, in the heating drum D, the limb part 2 and the claw part 4 are attached to the main body part 1, with the limb part 2 and the claw part 4 sandwiching a convex part between the cut-out part 1*a* and the groove part 1*c* of the main body part 1.

In this manner, in the heating drum D, the limb part 2 is fitted into the cut-out part 1*a* of the main body part 1, and the claw part 4 fixed onto the limb part 2 is freely movably fitted to the groove part 1*c*. For this reason, in the heating drum D, even when heated at a high temperature, the limb part 2 is prevented from being deviated in the width direction relative to the main body part 1 as much as possible.

Additionally, since the second coupling part K2 is the same as the first coupling part K1 except that it has a different length in the circumferential direction, the explanation thereof will be omitted.

On the other hand, as shown in FIG. 6(B), an end part 22 on which the limb-side cut-out part 2*a* of the limb part 2 is formed in the heating drum D is fitted to the narrow-width cut-out part 1*b*.

At this time, as described above, since a step part P is formed by the cut-out part 1*a* and the narrow-width cut-out part 1*b* (see FIG. 3(A)), the rotation of the limb part 2 relative to the main body part 1 is also regulated. Therefore, even when heated at a high temperature, the limb part 2 in the heating drum D is prevented from being deviated in the rotation direction relative to the main body part 1 as much as possible.

In the heating drum D relating to the present embodiment, the side face of the main body part 1 and the surface of the limb part 2 are flush with each other. Thus, the end part 21 on which the limb-side cut-out part 2*a* of the limb part 2 is not formed has the same width as that of the cut-out part 1*a* of the main body part, and the end part 22 on which the limb-side cut-out part 2*a* of the limb part 2 is formed has the same width as that of the narrow-width cut-out part 1*b*.

Thus, the working safety at the time of maintenance can be improved.

Moreover, in the heating drum D as described above, since the limb part 2 is attached by utilizing the claw part 4 in a manner so as to sandwich the convex part between the cut-out part 1*a* and the groove part 1*c* of the main body part 1, no fitting tool 5 is directly used for coupling the main body part 1 and the limb part 2. Therefore, another advantage can be obtained in that it is possible to prevent the fitting tool 5 from being loosened or coming off due to expansion of the main body part 1.

Next, explanation is given to an ink-jet printing device I in accordance with the present invention.

Figure 7:
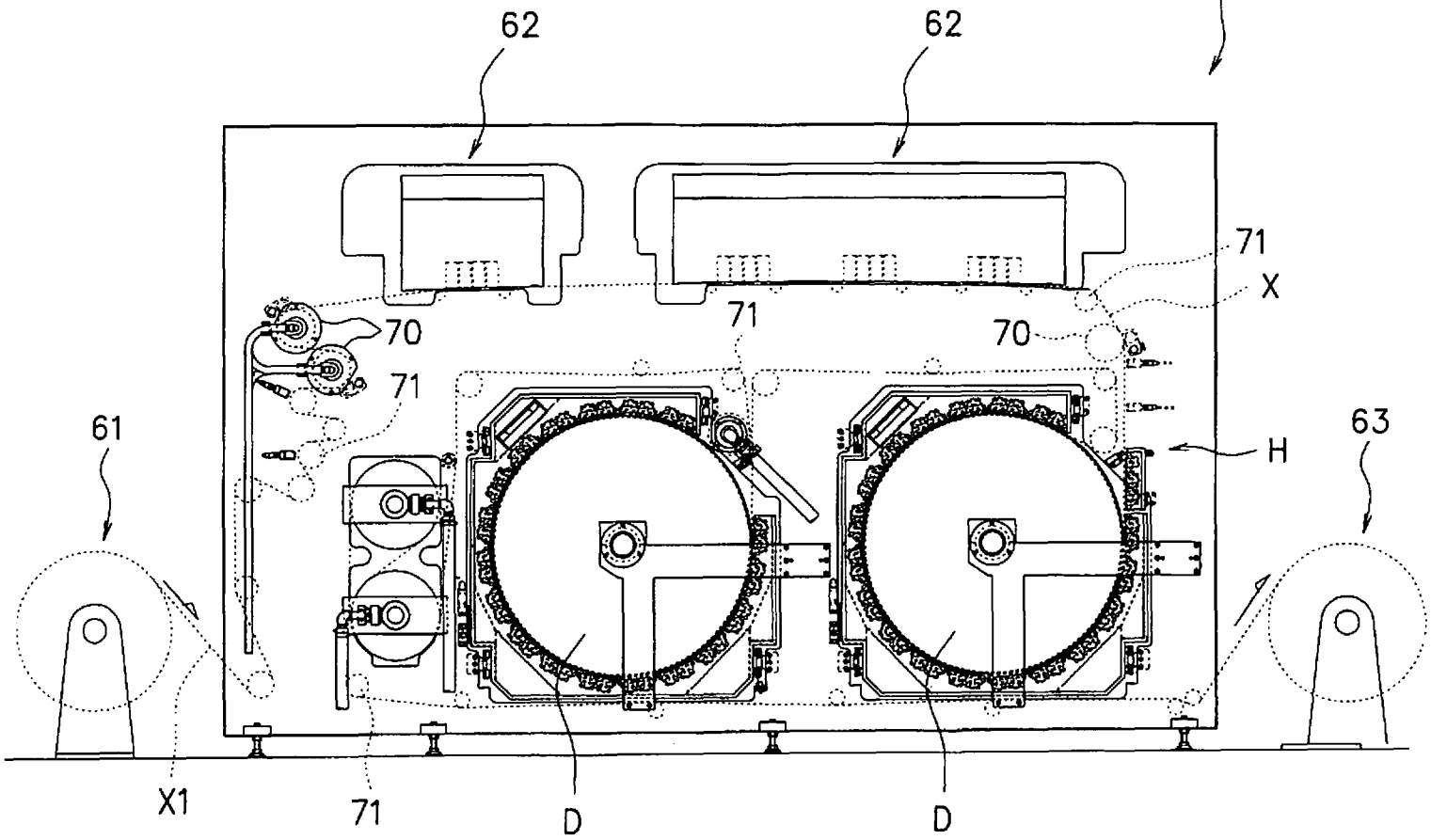
FIG. 7 is a perspective side view showing an embodiment of the ink-jet printing device in accordance with the present invention.

FIG. 7 is a perspective side view showing an embodiment of the ink-jet printing device I in accordance with the present invention.

As shown in FIG. 7, the ink-jet printing device I in accordance with the present embodiment is provided with a paper feeding part 61 for supplying a medium X1, a printing part 62 for printing the medium X1 while transporting it, a drying device H for drying a long-sized printed object X that has been printed by the printing part 62 while transporting it, and a collecting part 63 for collecting the dried printed object X.

Moreover, the drying device H is provided with heating drums D that are installed in parallel with each other on the upstream side and the downstream side.

In the ink-jet printing device I, the printing part 62 is constituted by a plurality of ink-jet printing heads. Additionally, as a system of the ink-jet printing heads, a line head system or a serial head system may be used.

Moreover, into each of the ink-jet printing heads, the aforementioned ink is filled for each of the colors of YMCK, or the like.

In the ink-jet printing device I, the printed object X is transported at a desired speed by rotating a pull roller 70 by a servo motor, not shown.

Moreover, the tension of the printed object X is detected by a tension roller 71 to which a tension sensor, not shown, using a load cell or the like is attached so that the rotation amount of the pull roller 70 can be adjusted by the servo motor so as to achieve a target tension.

Furthermore, the transporting path of the printed object X below the printing part 62 has an arch shape. Thus, it becomes possible to suppress flapping of the printed object X.

In the ink-jet printing device I, since the drying device H is provided with the heating drum D, the limb part 2 is prevented from being deviated relative to the main body part 1 of the heating drum D, even when heated at a high temperature.

Moreover, by installing the heating drums D in parallel with each other on the upstream side and the downstream side, the drying time relative to the printed object X to be transported can be made sufficiently longer.

Although preferred embodiments of the present invention have been explained above, the present invention is not intended to be limited by the above-mentioned embodiments.

In the heating drum D in accordance with the present embodiment, the main body part 1 has its outer circumferential surface subjected to irregularity machining; however, this process is not necessarily required.

Moreover, instead of the irregularity machining, thin grooves may be formed on the outer circumferential surface of the main body part 1.

In the heating drum D in accordance with the present embodiment, on the main body part 1, three sets of the band heaters 13 are installed in parallel with one another on its inner circumferential surface; however, the band heater 13 not limited by number or type as long as the main body part 1 can be heated. For example, one set or a plurality of sets of rubber heaters may be installed, or a plurality of rod-shaped heaters may be installed in a direction parallel to the axis direction inside the main body part 1.

Moreover, the number of the band heaters 13 placed in parallel with one another is not particularly limited.

In the heating drum D in accordance with the present embodiment, the groove parts 1*c* are formed over the entire inner circumferential surface of the main body part 1; however, these may be formed partially. For example, the groove part may be formed only at a position that allows the claw part 4 to be freely movably fitted thereto.

In the heating drum D in accordance with the present embodiment, the main body part 1 and the limb part 2 are coupled to each other by using the claw parts 4 and the fitting tools 5 at 8 positions; however, the number of the coupling positions is not intended to be limited by this number.

INDUSTRIAL APPLICABILITY

The heating drum D of the present invention can be utilized as a device which, while guiding a long-sized medium, heats and dries the medium. In accordance with the heating drum D, even when heated at a high temperature, the limb part 2 is prevented from being deviated relative to the main body part 1.

The ink-jet printing device I of the present invention can be utilized as a device in which, by applying an ink to a medium, characters and patterns can be printed thereon. In accordance with the ink-jet printing device I, since the heating drum D is installed, the limb part 2 is prevented from being deviated relative to the main body part 1 even when heated at a high temperature.

REFERENCE SIGNS LIST

1 . . . main body part,
1*a* . . . cut-out part,
1*b* . . . narrow-width cut-out part,
1*c* . . . groove part,
13 . . . band heater,
13*a* . . . power-source terminal,
13*b* . . . thermocouple,
13*c* . . . thermostat,
2 . . . limb part,
21, 22 . . . end part,
2*a* . . . limb-side cut-out part,
2*b* . . . limb-use fitting tool hole,
3 . . . shaft core,
3*a* . . . power-supply use rotary connector,
3*b* . . . signal-use rotary connector,
4 . . . claw part,
4*a* . . . hook part,
4*b* . . . pressing part,
4*c* . . . claw-use fitting tool hole,
5 . . . fitting tool,
61 . . . paper feeding part,
62 . . . printing part,
63 . . . collecting part,
70 . . . pull roller,
71 . . . tension roller,
D . . . heating drum,
H . . . drying device,
H1, H2, H5, H6 . . . distance,
H3, H4 . . . width,
I . . . ink-jet printing device,
K1 . . . first coupling part,
K2 . . . second coupling part,
P . . . step part,
S . . . hole part,
X . . . printed object,
X1 . . . medium

The invention claimed is:

1. A heating drum, which guides a long-sized medium and also heats and dries the medium, comprising:

a cylinder-shaped main body part;

disc-shaped limb parts attached to end parts of the main body part; and a shaft core attached to the limb parts, wherein on an edge of an inner circumferential surface of the main body part, a cut-out part that extends in the circumferential direction is formed and a groove part that extends in the circumferential direction is formed on the inner circumferential surface on an inner side from the cut-out part of the main body part, and the cut-out part and the groove part are in parallel with each other, and one of the limb parts is fitted to the cut-out part, with a claw part being fixed to the limb part by a fitting tool, so that a hook part of the claw part is freely movably fitted to the groove part.

2. The heating drum according to claim 1, wherein a side face of the main body part and a surface of the limb part are flush with each other.

3. The heating drum according to claim 1, wherein on the edge of the inner circumferential surface of the main body part, a cut-out part with a narrow width, which extends in the circumferential direction, is further formed, and the cut-out part and the narrow-width cut-out part are alternately disposed, with the width of the narrow-width cut-out part being set to be smaller than the width of the cut-out part, and a plurality of cut-out parts on a limb side are formed on the limb part with a predetermined interval so that an end part of the limb part with no limb-side cut-out part being formed thereon is fitted to the cut-out part, with an end part of the limb part with the limb-side cut-out part being formed thereon being fitted to the narrow-width cut-out part.

4. The heating drum according to claim 1, wherein a plurality of holes are formed in the limb part so that through the holes, the claw part is fixed to the limb part with the fitting tool.

5. The heating drum according to claim 4, wherein of the total surface area of the limb part, the sum of the surface areas occupied by the plural holes is set to a ratio of 30% or more.

6. An ink-jet printing device comprising: a printing part which, while transporting a long-sized medium, carries out a printing process thereon, and a drying device which, while transporting a medium formed by applying a printing process onto the medium by the printing part, dries the medium, wherein the printing part is constituted by a plurality of ink-jet printing heads, and the drying device is provided with the heating drum described in claim 1.

7. The ink-jet printing device according to claim 6, wherein a plurality of heating drums comprising the heating drum are installed in parallel with each other on upstream and downstream sides in the transporting direction.

* * * * *